US007500938B2

(12) United States Patent
Fan

(10) Patent No.: US 7,500,938 B2
(45) Date of Patent: Mar. 10, 2009

(54) ROWING EXERCISE DEVICE

(75) Inventor: Jeeng-Neng Fan, Taoyuan (TW)

(73) Assignee: Hsin Lung Accessories Co., Ltd., Hsin Chu Hsien (TW)

( * ) Notice: Subject to any disclaimer, the term of this patent is extended or adjusted under 35 U.S.C. 154(b) by 0 days.

(21) Appl. No.: 11/654,537

(22) Filed: Jan. 18, 2007

(65) Prior Publication Data

US 2007/0191191 A1 Aug. 16, 2007

(30) Foreign Application Priority Data

Feb. 16, 2006 (TW) ..... 95202623 U

(51) Int. Cl.
*A63B 69/06* (2006.01)
*A63B 21/068* (2006.01)

(52) U.S. Cl. ..... 482/72; 482/95

(58) Field of Classification Search ..... 482/72–73, 482/95–96, 51–52

See application file for complete search history.

(56) References Cited

U.S. PATENT DOCUMENTS 3,912,264 A * 10/1975 Busse et al. ..... 482/72
4,684,126 A * 8/1987 Dalebout et al. ..... 482/138
4,743,010 A * 5/1988 Geraci ..... 482/72
4,867,447 A * 9/1989 Johnson ..... 482/73
5,580,340 A * 12/1996 Yu ..... 482/96
7,104,933 B1 * 9/2006 Liao ..... 482/72
7,115,077 B2 * 10/2006 Yang ..... 482/73

* cited by examiner

*Primary Examiner*—Fenn C Mathew
(74) *Attorney, Agent, or Firm*—Rosenberg, Klein & Lee

(57) ABSTRACT

The present invention relates to an improved rowing exercise device includes one base, two rowing widgets, one driving widget, one footrest widget, one hoisting widget and one cushion. Making use of the driving widget to drive rowing widget, footrest widget and hoisting widget synchronously, operator, who sits on the cushion and stays on the hoisting widget, will be able to operate rowing handle to practice rowing action with hands and his feet will co-operate with the action of sway-forward and sway-backward of the footrest widget to practice stretching-and-bending exerting action at the same time; moreover, hoisting widget can load the operator's body up and down synchronously. By means of harmony-operation, not only the purpose of stretching and exercise hands, feet belly and thorax can be reached, but also improves the effect of reality and fun of rowing sport.

4 Claims, 9 Drawing Sheets

ROWING EXERCISE DEVICE

BACKGROUND OF THE INVENTION

1) Field of the Invention

The present invention relates to an improved rowing exercise device, especially with advantages as conciseness, easy operation, convenience and sense of reality and delight for practicing said rowing exercise device. Furthermore, expected goals and effects of exercising and body-building can be unrolled, and said rowing exercise device is unprecedented and has the features of practicability, perfection and advancement.

2) Description of the Related Art

There are many kinds of well-known rowing exercise device, and, among which, the most familiar one, as shown in FIG. 1, has a cushion 2 on its collateral two slide-tracks 1, a revolving tube 3 located on outside of each slide-track 1, an oil-pressure cylinder 4 and a cross joint 5 located on each of revolving tube 3, rowing handle 6 set on the cross joint 5, and two footrests 7 set at the position between the front-end of said two slide-tracks 1. When operating said device, operator sits on cushion 2; lay his feet on footrests 7, and his hands practice rowing action with rowing handles 6. When rowing handles 6 are pulling backward, piston 41 of oil-pressure cylinder 4 will be pulled outward to create damping effect, and his two foot-soles will stretch straight gradually with footrests 7 as force fulcrums. This will make cushion 2 moves backward along slide-tracks 1. When rowing handles 6 are pushing forward to make piston 41 of oil-pressure cylinder 4 draw backward, operator's feet will be bending gradually and his bottom will push cushion 2 to move forward for preparing next cycle of backward-pulling action for rowing handles 6. Making use of damping effect of oil-pressure cylinder 4, operator can enjoy the effects of exercising hands, feet and belly and the result of stretching body.

The foregoing rowing exercise device may procure the purpose and effect of indoor exercise, but some defects will be happened as follows:

1. The action of exercising hands and feet is making use of damping effect of oil-pressure cylinder, but oil-pressure cylinder is expensive and will be easy to leak oil after long-term operation.
2. Since cushion bear operator's body weight to move forward and backward on slide-tracks continuously, the sliding components will be worn out and will not move smoothly after log-term operation. This will affect the smoothness of the operation of rowing exercise device and limit exercise effect.
3. Since cushion and operator's body need to move forward and backward on practicing rowing action, this is contrary to real rowing action and lack of sense of reality and fun.

From aforesaid descriptions, we know the structure and operation of the well-known rowing exercise device have defects and can be improved.

SUMMARY OF THE INVENTION

The first objective of the invention herein is to provide an improved rowing exercise device; wherein, the footrests can move forward and backward; hoisting widget hold cushion, and driving widget can drive rowing widget, footrests and hoisting widget synchronously. Hence, operator's feet can automatically exercise bend-and-stretch action via the swaying movement of footrests, when his hands are practicing rowing action. At the same time, said hoisting widget can carry operator's body to move up and down. Operator can exercise his feet, hands, belly and thorax to reach the purpose and effect of stretching and building body via the action of his own body weight.

The second objective of the invention herein is to provide an improved rowing exercise device; wherein, the drag force needed for reaching the effect of stretching and building body is created by operator's own body weight but not well-known oil-pressure cylinder. Therefore, manufacture cost and maintenance requirement will be diminished a lot.

The third objective of the invention herein is to provide an improved rowing exercise device; wherein, when practicing rowing action, said cushion moves upward and downward at its original position but not well-known forward and backward movement. Said up-and-down movement will exclude the well-known defects of sliding un-smoothly and unreality of rowing action, and make the rowing exercise have more fun and reality.

BRIEF DESCRIPTION OF THE DRAWING

Other features and advantages of the present invention will become apparent in the following detailed description of the preferred embodiments, with reference to the accompanying drawings, in which:

FIG. 7-1 is an enlarged schematic view of the partial structure of FIG. 7.

FIG. 9-1 is an enlarged schematic view of the partial structure of FIG. 9.

DETAILED DESCRIPTION OF THE PREFERRED EMBODIMENTS

Figure 1:
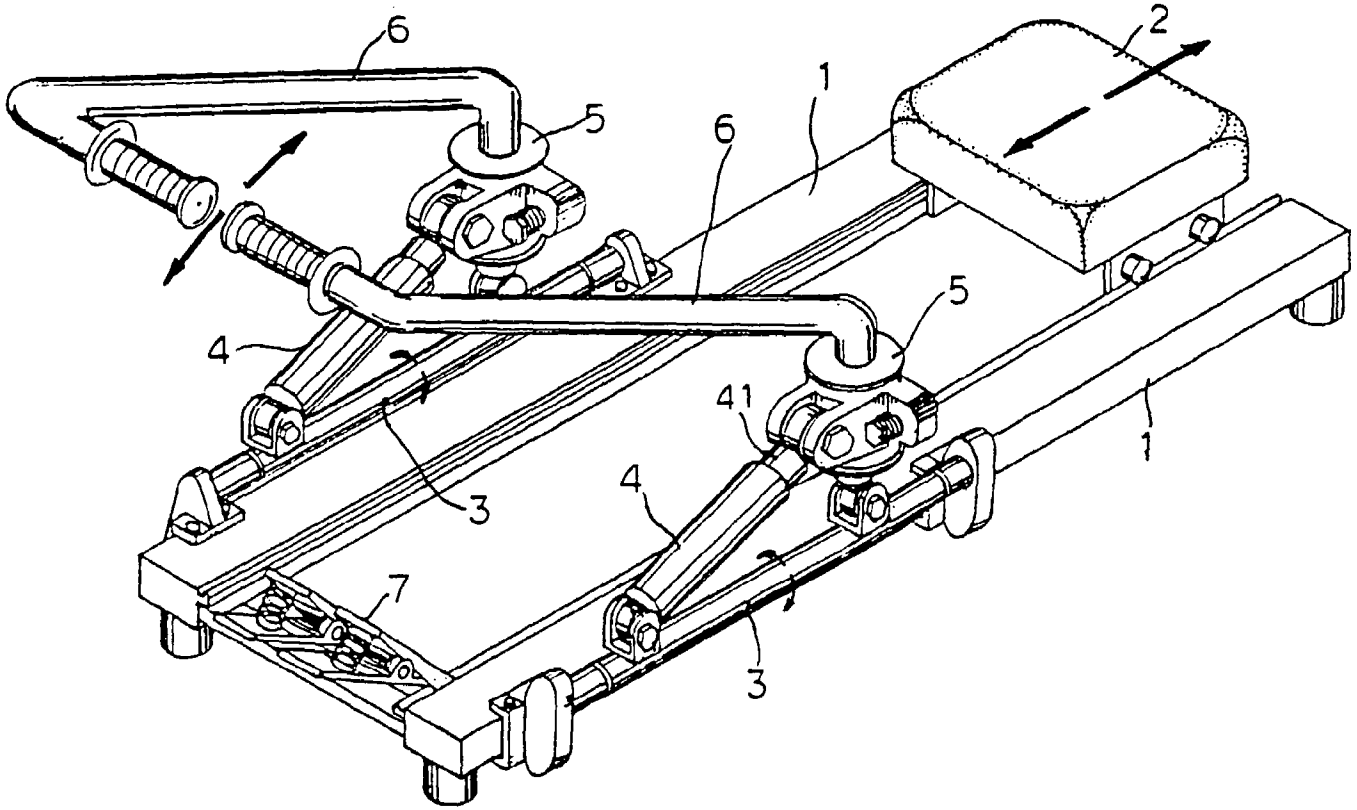
FIG.1 PRIOR ART
FIG. 1 is a 3-D view of the well-known rowing device for building body.
Figure 2:
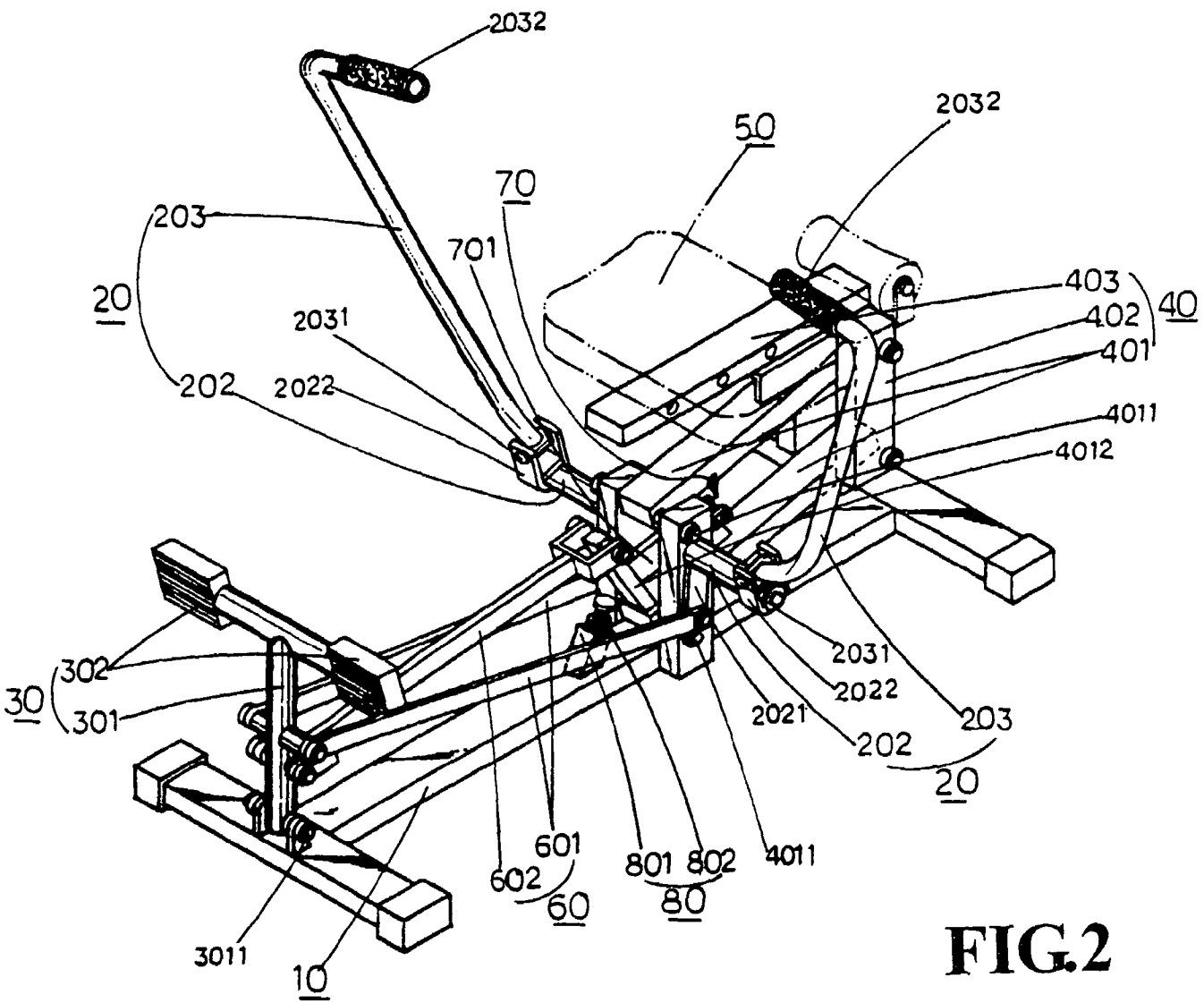
FIG. 2 is a 3-D schematic view of the invention.
Figure 3:
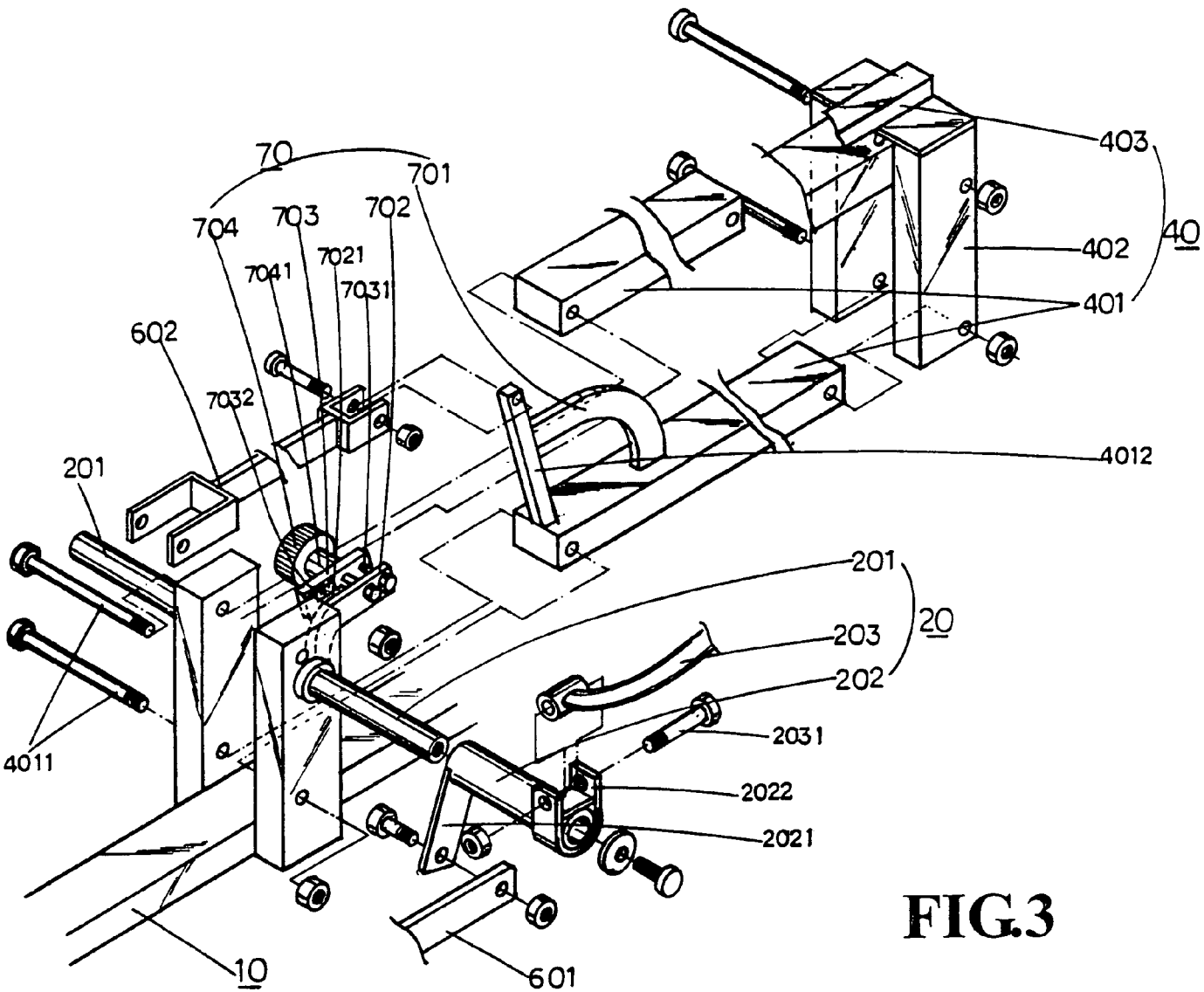
FIG. 3 is an exploded view of the partial structure of the invention.
Figure 4:
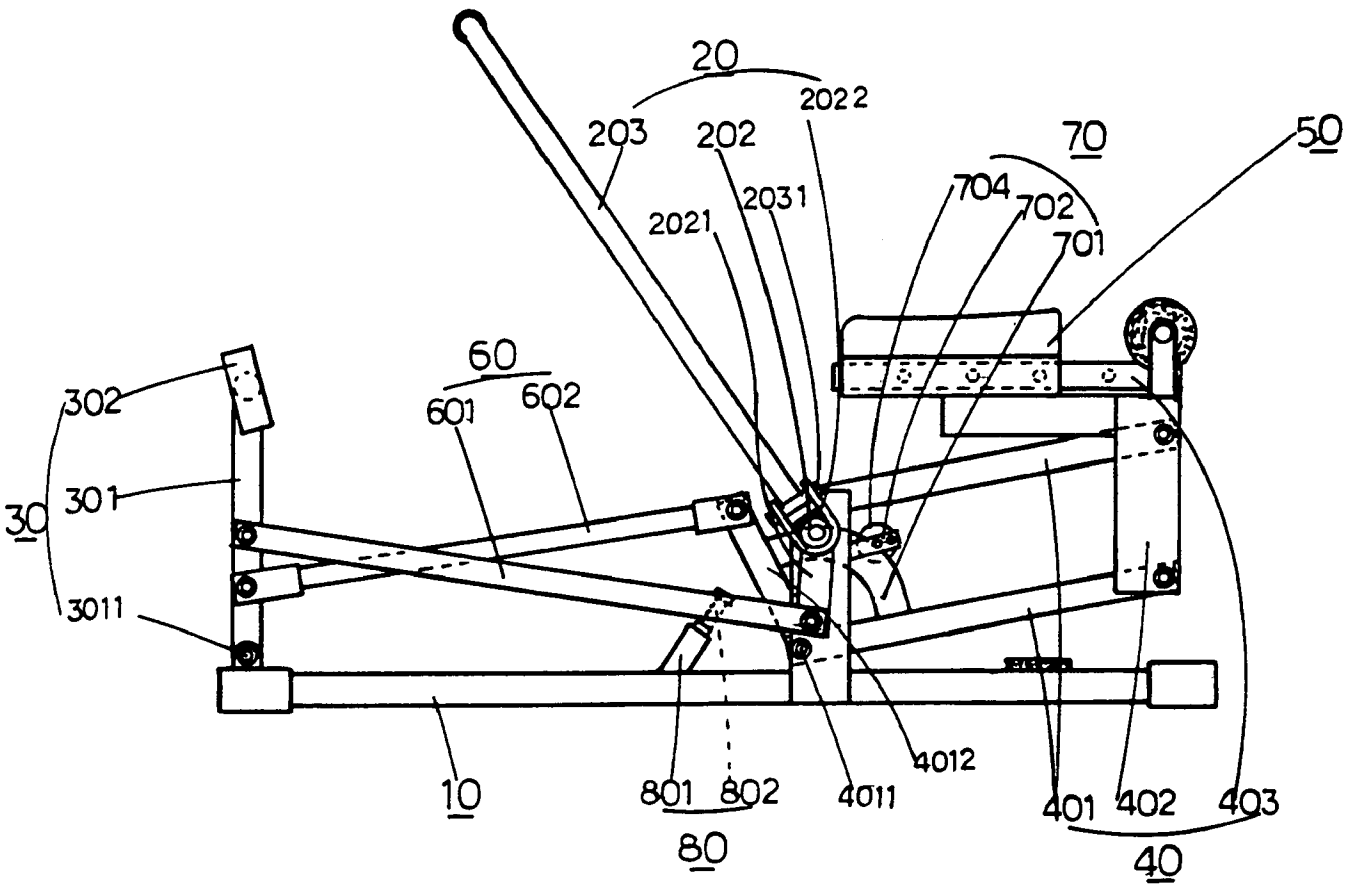
FIG. 4 is a façade schematic view of FIG. 2.

In the detailed description of the preferred embodiments, it should be noted that like elements are indicated by the same reference numerals throughout the disclosure.

Figure 6:
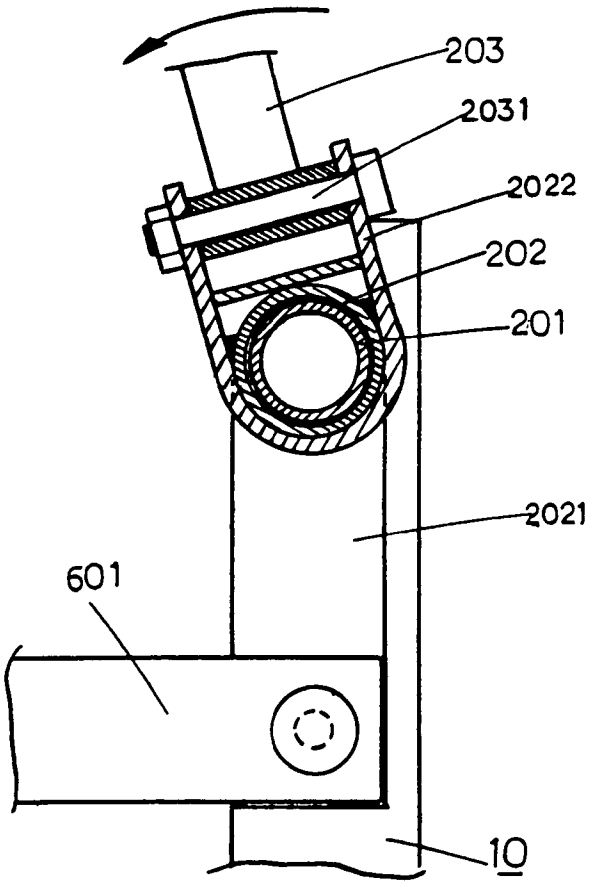
FIG. 6 is a schematic view of the pushing-rowing-handle-frontward situation of the rowing widget of the invention.
Figure 5:
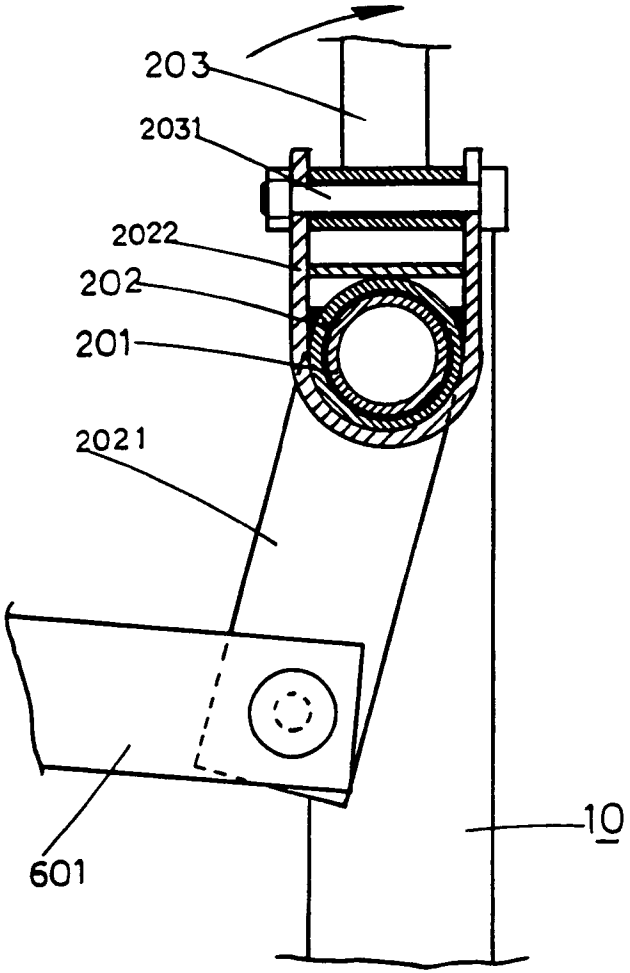
FIG. 5 is a schematic view of the pulling-rowing-handle-backward situation of the rowing widget of the invention.
Figure 8:
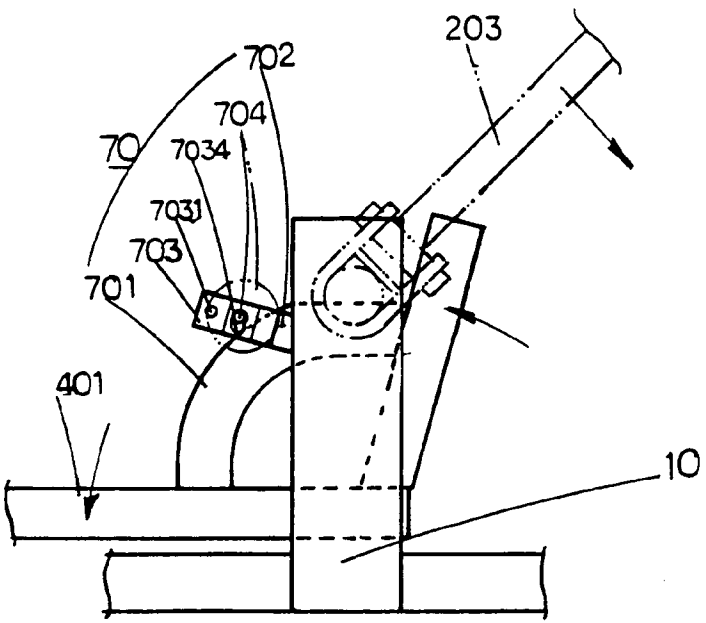
FIG. 8 is a façade schematic view of FIG. 7.
Figures 1, 7:
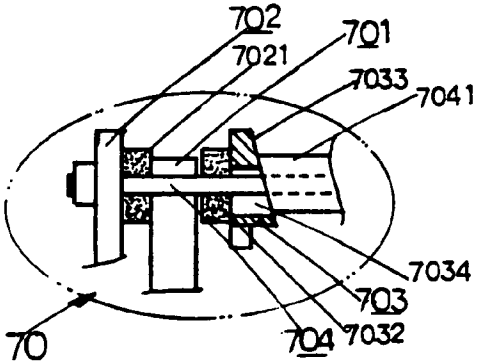
FIG. 7 is a side schematic view of the situation for pushing the invention's rowing handle frontward to make resistance auxiliary widget to create less friction.
Figure 7:
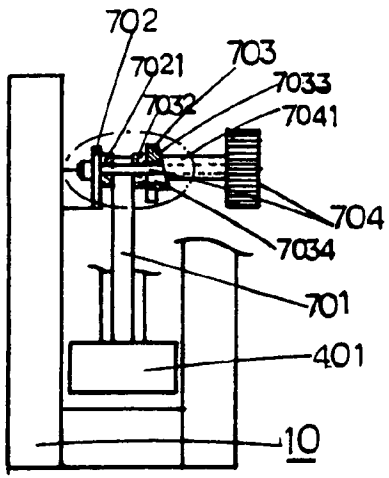
Figure 10:
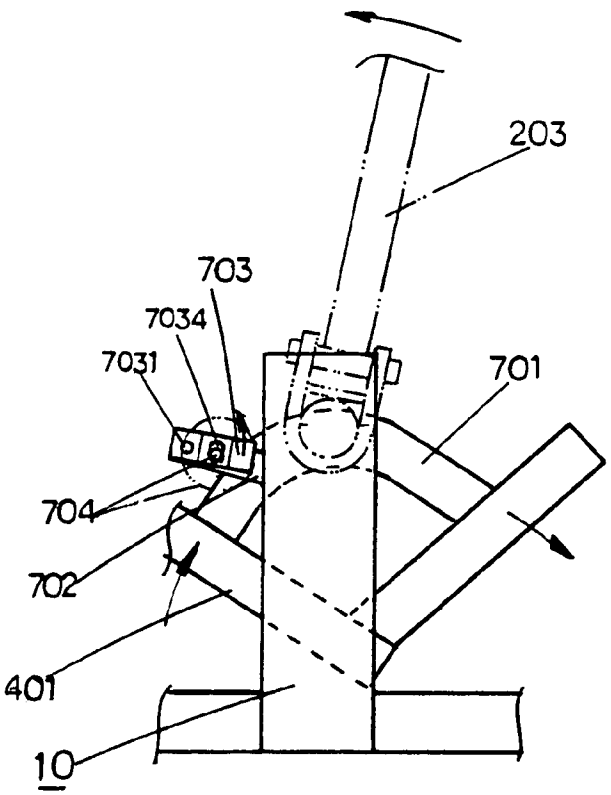
FIG. 10 is a façade schematic view of FIG. 9.
Figures 1, 9:
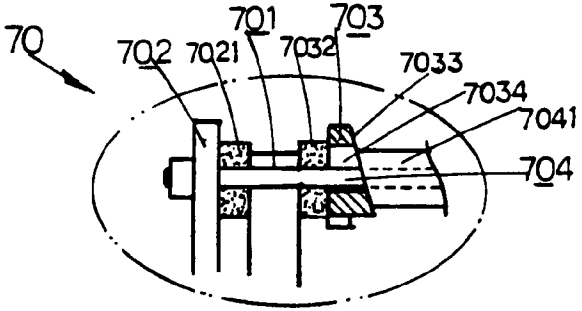
FIG. 9 is a side schematic view of the situation for pushing the invention's rowing handle backward to make resistance auxiliary widget to create more friction.
Figure 9:
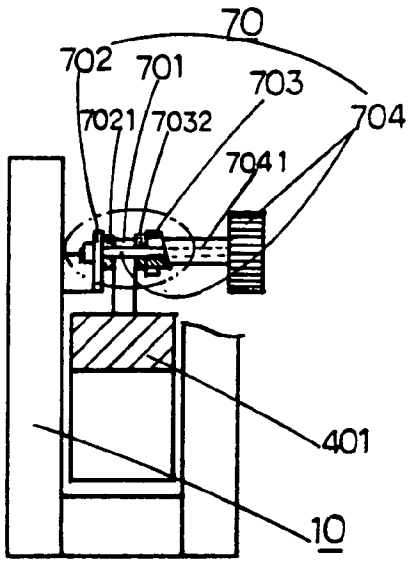

Please refer to detail description of FIGS. 2, 3, 4, 5, and 6 in advance; they clearly show an improved rowing exercise device of the present invention includes:

one base 10 accommodates the following widgets;

two rowing widgets 20 are respectively set on the right-hand side and left-hand side of said base 10 with respective positioning shaft 201 for fixing itself on base 10; one sleeve 202 cases positioning shaft 201 with one sway plate 2021 on one end and ear-like piece 2022 on the other end; one rowing handle 203 is fixed on ear-like piece 2022 of sleeve 202 by positioning bolt 2031 for revolving rightward and leftward and equipped with grasping-handle 2032 on the other end; when operating rowing handle 203, not only can sway left and right with positioning bolt 2031 as a hub, but also push frontward or pull backward; in addition, sleeve 202 can revolve freely with position shaft 201 as a hub (detail shown in FIG. 5 and FIG. 6);

one footrest widget 30 has a sway stick 301 whose one end is set on the front end of base 10 by positioning bolt 3011 which acts as a motion hub to make said sway stick to be able to sway forward and backward, and pedal 302 is set on the other end for bearing operator's stepping;

one hoisting widget 40 has two parallel holding sticks 40 whose one end is set on base 10 by positioning bolt 4011 and the other end connects a linkage rod 402; a driving rod 4012 is set on one of the holding sticks 401; a guiding track 403 is set on the upper end of the linkage rod 402; upon pulling the driving rod 4012, linkage rod 402 set on the other end of said two holding sticks 401 and guiding track 403 will move up and down vertically;

one cushion 50 is set on the guiding track 403 of said hoisting widget 40 and will be able to move up and down vertically complying with said hoisting widget 40;

one driving widget 60 has the first linkage rod 601 which is set as motion hub at the position between sway plate 2021 of rowing widget and sway stick 301 of footrest 30 for linking the actions of rowing widget 20 and footrest 30; in addition, when pulling rowing handle 203 backward to make sway plate 2021 of sleeve 202 sway forward, sway stick 301 of footrest 30 will be pushed to sway forward; on the contrary, when pushing rowing handle 203 forward, sway stick will sway backward; the second linkage rod 602 is set as motion hub at the position between sway stick 301 of footrest 30 and driving rod 4012 of hoisting widget 40 for linking the actions of hoisting widget 40, footrest 30 and rowing widget 20; in addition, when pulling rowing handle 203 backward to make sway stick 301 of footrest 30 sway forward, driving rod 401 of hoisting widget 40 will be driven to move forward and downward, and linkage rod 402 on the other end of said two holding sticks 40 will be driven to move upward vertically; on the contrary, when pushing rowing handle 203 forward to make sway stick 301 of footrest 30 sway backward, linkage rod 402 of hoisting widget 40 will be driven to move downward; in a word, by driving of the first linkage rod 601 and the second linkage rod 602, when pulling rowing handle 203 backward, sway stick 301 of footrest 30 will be linked to sway forward, and the coupling end of the linkage rod 402 of the hoisting widget 40 will be linked to move upward to lift cushion 50 set on it to move upward; on the contrary, when pushing rowing handle 203 forward, sway stick 301 of footrest 30 will be linked to sway backward, and the coupling end of the linkage rod 402 of the hoisting widget 40 will be linked to move downward to drive cushion 50 set on it to move downward;

one resistance auxiliary widget 70, referring to FIGS. 7, 8, 9, and 10, has a resistance plate 701 set on one holding stick 401 of the hoisting widget 40, and a positioning plate 702, on which set a frictional plate 7021 for corresponding resistance plate 701,is fixed on base 10 and at one side of the resistance plate 701; a mobile plate 703 is fixed as motion hub on positioning plate 702 by positioning bolt 7031; in addition, mobile plate 703 is located on the other side of resistance plate 701 and can proceed displacement adjustment for the support of the shield of the adjusting bolt 704 and; a frictional plate 7032 is set on mobile plate 703 for corresponding to resistance plate 701; an upside-thin-and-downside-thick inclined-plane 7033 is set on the foregoing mobile plate 703 for supporting shield 7041 of the adjusting bolt 704, and a long hole 7034 is set on the foregoing mobile plate 703 for accommodating the penetration of adjusting bolt 704. By these components and as shown on FIGS. 7, 7-1, and 8, when push rowing handle 203 forward and resistance plate 701 of resistance auxiliary widget 70 and holding stick 401 of hoisting widget 40 sway downward one by one, the aforesaid mobile plate 703 inclined to resistance plate 701 via frictional plate 7032 will follow resistance plate 701 to sway downward by means of positioning bolt 7031 as a turning point. Moreover, since the inclined-plane 7033 for supporting shield 7041 of the adjusting bolt 704 is upside-thin-and-downside-thick-shaped, the supporting force will be decreasing when sway downward one by one, and the friction exerted to resistance plate 701 by frictional plate 7032 will be decreasing as well. On the contrary, as shown on FIGS. 9, 9-1, and 10, when pull rowing handle 203 backward and resistance plate 701 of resistance auxiliary widget 70 and holding stick 401 of hoisting widget 40 sway upward one by one, the aforesaid mobile plate 703 will follow to sway upward one by one, and make its inclined plane 7033 come closer and closer to shield of adjusting bolt 704 via downside thicker part, and frictional plate 7032 will exert stronger friction on resistance plate 701;

one supporting widget 80, which is set on base 10 and at the front side of hoisting widget 40, has a shield 801 and an adjusting bolt 802 to barricade the sway-forward angle of driving rod 4012 of the hoisting widget 40.

Figure 11:
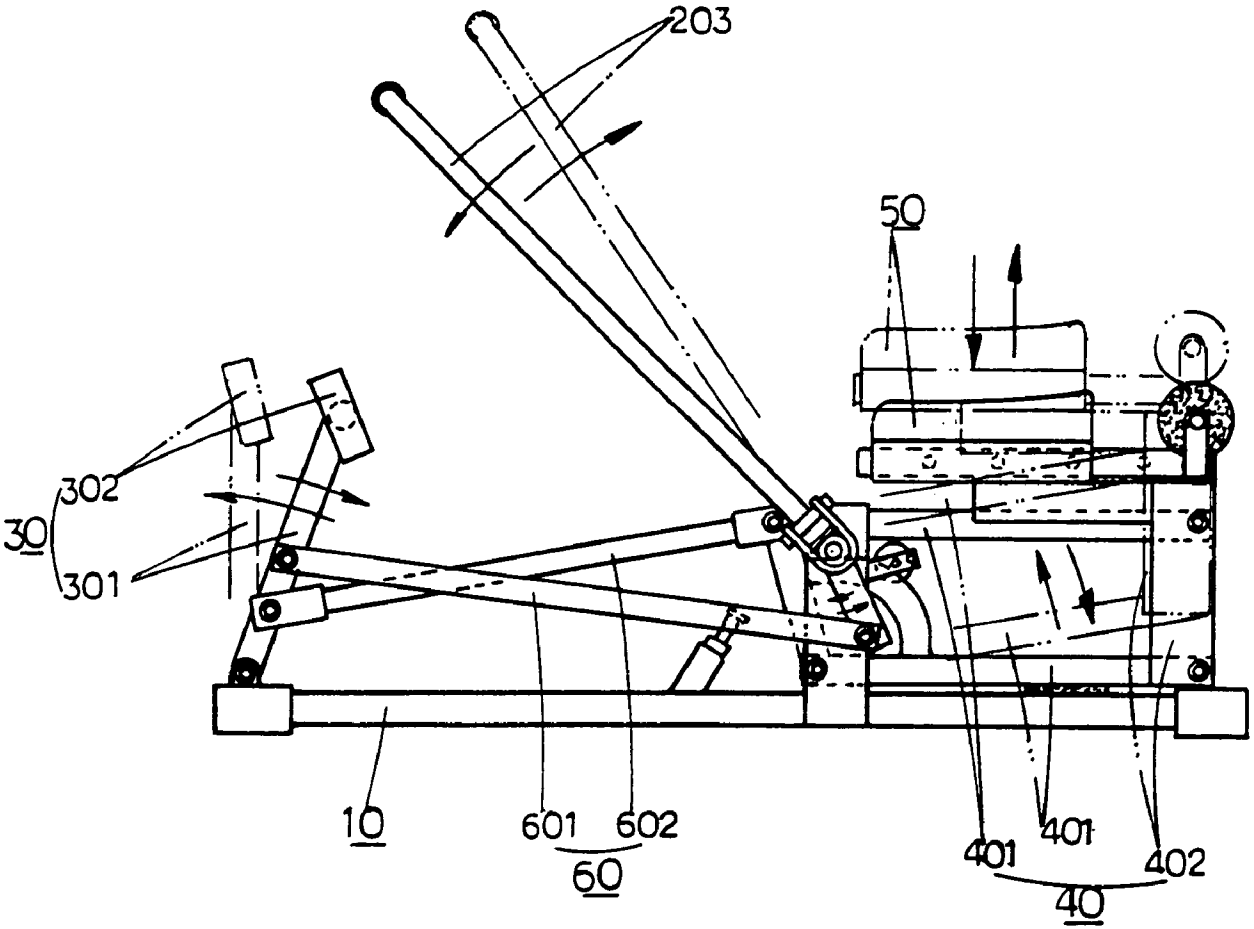
FIG. 11 is a motion figure embodiment (1) for operating the present invention.
Figure 12:
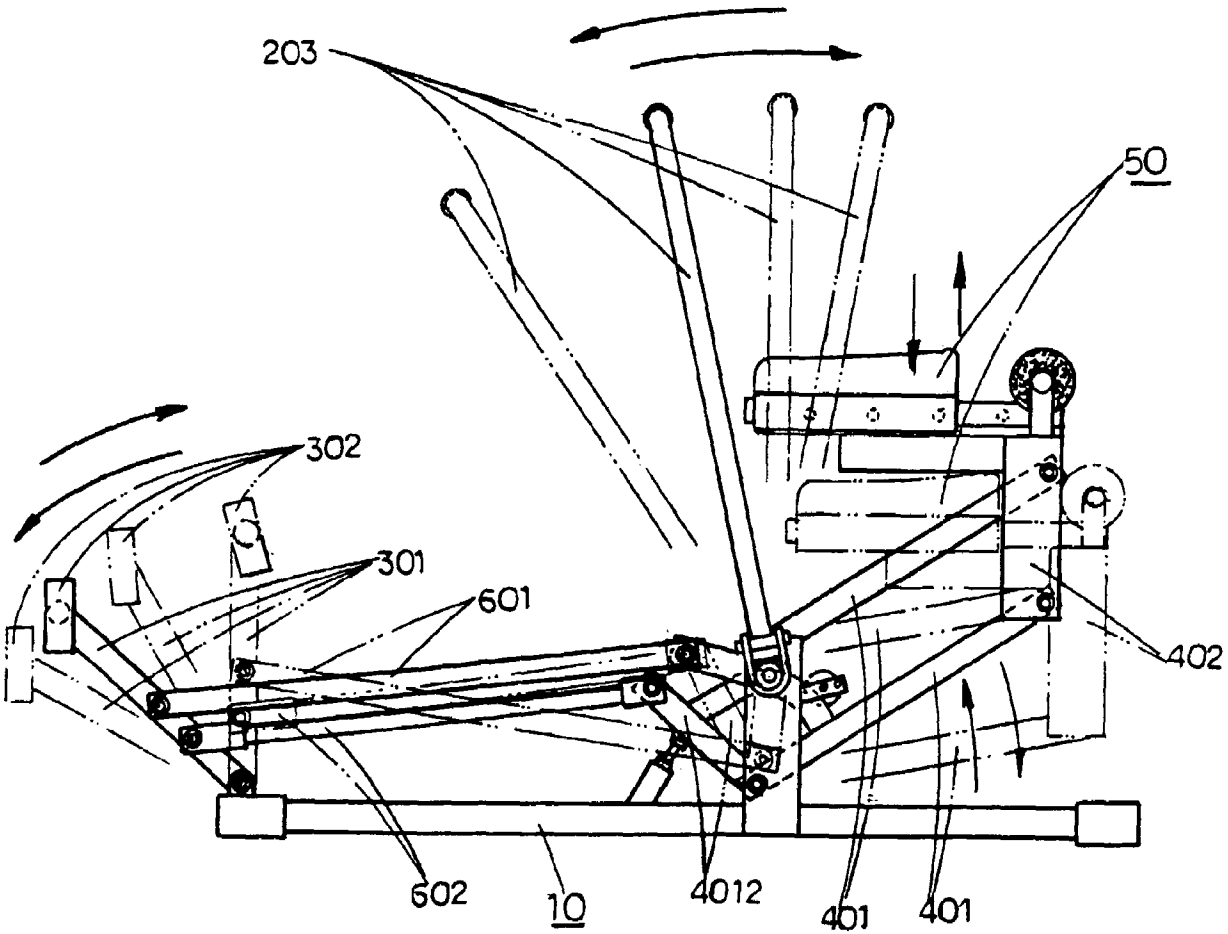
FIG. 12 is a motion figure embodiment (2) for operating the present invention.

The present invention is constructed as paragraphs mentioned above, and please refer to FIG. 11 and FIG. 12. When operator practices the present invention, firstly, he will sit on cushion 50 and lay his feet on pedal 302 of footrest 30. When operator's hands pull rowing handles 203 of rowing widget 20 backward, by means of coupling with driving widget 60, the sway stick 301 of the footrest widget 30 will be linked to sway forward to make his feet stretch forward for exerting action. Meanwhile, said hoisting widget 40 will be linked to sway upward to make cushion 50 and operator's body go upward vertically. Since operator's body weight is directly loaded at cushion 50 and hoisting widget 40, hands and feet driving rowing widget 20 and footrest widget 30 can directly reach the effect of exerting, exercise and body-stretching. Moreover, when operator's hands push rowing handles 203 of rowing widget 20 forward, by means of coupling with driving widget 60, the sway stick 301 of the footrest widget 30 will be linked to sway backward to make his feet bend backward for preparing next stretch-forward action. Meanwhile, make use of operator's body weight to press said cushion 50 and hoisting widget 40 will be driven by driving widget 60; cushion 50 and hoisting widget 40 will go downward one by one and operator's body will go downward vertically but not move forward and backward to co-operate with rowing widget 20 and footrest widget 30 for next exerting action. By repeating these steps, via practicing the present invention, operator can reach the effect and purpose of exercise and body-stretching on feet, hands, belly and whole body. Since said cushion 50 moves up and down but not forward and backward, the present invention will be much closer to real rowing sport. When practicing the present invention, operator will enjoy more reality and fun, and the expected purpose and effect of exercising and exercise will be promoted.

Since the resistance created by operator's practicing rowing action is mainly from the operator's body weight exerting on cushion 50 and hoisting widget 40, but not from the damping effect of oil-pressure cylinder, the present invention reduces costs of manufacture and maintenance a lot.

Furthermore, the present invention uses operator's body weight to be the load of rowing sport to reach the expected purpose of exercising and exercise; in addition, making use of said resistance, resistance auxiliary widget 70 can apply extra frictional resistance on holding stick 401 of hoisting widget 40. Therefore, operator can reach the effect of timely adding the load to match the load requirement on rowing sport by adjusting resistance auxiliary widget 70, when it is needed.

Moreover, since supporting widget 80 set on base 10 can simultaneously control the angle of sway-forward of driving rod 4012 of hoisting widget 40 when adjusting the high and low of adjusting bolt 802, operator can control the angle of rowing handle 203 of rowing widget 20, the angle of sway-forward of the sway stick of the footrest 30 and the rising height of said cushion 50 of the hoisting widget 40 by adjusting supporting widget 80.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A rowing exercise device comprising:

a base;

two rowing widgets respectively set on two sides of said base, each rowing widget having a positioning shaft for coupling to the base;

a sleeve case positioning shaft with a sway plate on one end and an car-like piece on an other end;

a rowing handle having a lower end fixed on the ear-like piece of the sleeve case positioning shaft as a motion hub for rotation in opposing directions;

a footrest widget having a sway stick with one end thereof set as a motion hub on a front end of said base so said sway stick is able to sway forward and backward, an opposing end of said sway stick having pedals disposed thereon;

a hoisting widget having at least two parallel holding sticks, each stick having one end adapted as an up-and-down correspondent motion hub coupled to the base and an opposing end coupled to a linkage rod, wherein a driving rod is disposed on one of the holding sticks, a guiding track is disposed on an upper end of the linkage rod, and a cushion is disposed on the guiding track of said hoisting widget; and a driving widget including:

a first linkage rod set as a motion hub at a position between the sway plate of the rowing widget and the sway stick of the footrest links the actions of the rowing widget and the footrest, wherein, when pulling the rowing handle backward to make the sway plate of the sleeve case positioning shaft sway forward, the sway stick of the footrest will be pushed to sway forward; and, when pushing the rowing handle forward, the sway stick will sway backward;

a second linkage rod set as a motion hub at a position between the sway stick of the footrest, and the driving rod of the hoisting widget links the actions of the hoisting widget, footrest and rowing widget, wherein, when pulling the rowing handle backward to make the sway stick of the footrest sway forward, the driving rod of the hoisting widget will be driven to move forward and downward, and the linkage rod of the hoisting widget on the other end of said two holding sticks will be driven to move upward vertically, and when pushing the rowing handle forward to make the sway stick of the footrest sway backward, the linkage rod of the hoisting widget will be driven to move downward.

2. A rowing exercise device as claimed in claim 1, wherein said supporting widget has a shield and an adjusting bolt to barricade the sway-forward angle of the driving rod of the hoisting widget.

3. A rowing exercise device as claimed in claim 2, wherein a resistance auxiliary widget set on said base and said hoisting widget has a resistance plate disposed on one of the holding sticks of the hoisting widget; a positioning plate is fixed on said base and at one side of said resistance plate, and a frictional plate corresponding to the resistance plate is disposed on said positioning plate; a mobile plate is fixed as a motion hub on the positioning plate and on an other side of the resistance plate to provide displacement adjustment for the support of the shield of the adjusting bolt, and a frictional plate is disposed on the mobile plate corresponding to the resistance plate.

4. A rowing exercise device as claimed in claim 3, wherein the mobile plate of the resistance auxiliary widget has an upside-thin-and-downside-thick inclined-plane for supporting said shield of said adjusting bolt, and a long hole is set on said mobile plate for accommodating a penetration of said adjusting bolt.

* * * * *